US010688380B2

(12) United States Patent
Aronson et al.

(10) Patent No.: US 10,688,380 B2
(45) Date of Patent: Jun. 23, 2020

(54) ROTATING BALL-IN-A-MAZE PUZZLE GAME

(71) Applicant: WOWWEE GROUP LTD., Hong Kong (HK)

(72) Inventors: Dan Aronson, Westmount (CA); Davin Sufer, Hampstead (CA); Adam Fairless, La Jolla, CA (US); Anthony Lemire, Montreal (CA)

(73) Assignee: WOWEE GROUP LTD., Hong Kong (HK)

( * ) Notice: Subject to any disclaimer, the term of this patent is extended or adjusted under 35 U.S.C. 154(b) by 0 days.

(21) Appl. No.: 16/412,199

(22) Filed: May 14, 2019

(65) Prior Publication Data

US 2019/0262696 A1 Aug. 29, 2019

Related U.S. Application Data

(62) Division of application No. 15/913,636, filed on Mar. 6, 2018, now Pat. No. 10,589,167.

(60) Provisional application No. 62/468,393, filed on Mar. 8, 2017, provisional application No. 62/638,318, filed on Mar. 5, 2018.

(51) Int. Cl.

| | |
|---|---|
| ***A63F 7/04*** | (2006.01) |
| ***A63F 7/30*** | (2006.01) |
| *A63F 9/24* | (2006.01) |

(52) U.S. Cl.

CPC ..... *A63F 7/041* (2013.01); *A63F 7/044* (2013.01); *A63F 7/30* (2013.01); *A63F 2007/304* (2013.01); *A63F 2007/3035* (2013.01); *A63F 2009/2482* (2013.01)

(58) Field of Classification Search

CPC .. A63F 7/041; A63F 7/30; A63F 7/044; A63F 2007/3035; A63F 2007/304; A63F 2009/2482; A63F 7/36; A63F 7/3622; A63F 7/38

USPC ..... 273/153 R, 153 S, 157 R; 434/426

See application file for complete search history.

(56) References Cited

U.S. PATENT DOCUMENTS

| | | | | |
|---|---|---|---|---|
| 600,696 A | | 3/1898 | Patterson | |
| 766,118 A | | 7/1904 | Saunders | |
| 2,439,583 A | * | 4/1948 | Shamah | A63F 9/10 40/525 |
| 2,563,608 A | | 8/1951 | Laufer | |
| 3,235,262 A | * | 2/1966 | Frankl | A63F 9/0803 273/155 |
| 3,406,971 A | | 10/1968 | Koff | |
| 3,417,996 A | | 12/1968 | Janiszewski | |

(Continued)

FOREIGN PATENT DOCUMENTS

| | | |
|---|---|---|
| CA | 1259346 A | 9/1989 |
| FR | 2907020 A1 | 4/2008 |

OTHER PUBLICATIONS

Definition of "Belt", <www.dictionary.com/browse/belt>, retrieved on Dec. 13, 2019, pp. 1-7. (Year: 2019).*

*Primary Examiner* — Steven B Wong
(74) *Attorney, Agent, or Firm* — Merchant & Gould P.C.

(57) ABSTRACT

A moving ball-in-a-maze puzzle game includes at least two moving maze rings. Each maze ring includes a respective maze, the maze rings moving relative to one another over a platform, defining dynamic paths therebetween enabling maneuvering a ball on the platform from a start position to an end position through the mazes, while passing between the respective moving maze rings.

6 Claims, 8 Drawing Sheets

(56) References Cited

U.S. PATENT DOCUMENTS 3,712,617 A * 1/1973 Ohlschlager ..... A63F 7/047 273/153 R
3,785,651 A * 1/1974 Smith ..... A63F 9/0078 273/113
4,332,385 A 6/1982 McCaslin
4,427,387 A * 1/1984 Tomita ..... G09B 11/06 281/14
4,452,455 A * 6/1984 Bergstrom ..... A63F 9/0811 273/142 HA
4,560,164 A * 12/1985 Darling ..... A63F 9/0098 273/155
4,570,935 A * 2/1986 Stefanini ..... A63F 7/0088 273/153 R
4,667,960 A 5/1987 Stefanini
4,685,679 A 8/1987 Ben-Gal et al.
4,822,047 A * 4/1989 Treer ..... A63F 7/042 273/110
4,869,506 A 9/1989 Wiggs et al.
5,281,039 A * 1/1994 Hsiung ..... A63F 7/042 273/113
5,441,260 A * 8/1995 Gogarty ..... A63F 9/0078 273/153 R
5,451,055 A * 9/1995 Lo ..... A63F 7/042 273/113
5,634,641 A 6/1997 Roman
5,711,523 A * 1/1998 Sternberg ..... A63F 3/0423 273/153 R
5,884,912 A * 3/1999 Ignatiev ..... A63F 9/0078 273/153 S
8,011,662 B2 9/2011 Black
D701,577 S 3/2014 Harvey
8,695,980 B1 * 4/2014 Gonter ..... A63F 9/0803 273/155
9,067,129 B2 * 6/2015 Encina Cusi ..... A63F 7/042
2012/0286472 A1 * 11/2012 Harvey ..... A63F 9/0612 273/153 R
2016/0375351 A1 12/2016 Wertz

* cited by examiner

ROTATING BALL-IN-A-MAZE PUZZLE GAME

This application is a Divisional of U.S. patent application Ser. No. 15/913,636, filed Mar. 16, 2018, which claims benefit of U.S. Provisional Patent Application No. 62/468,393, filed Mar. 8, 2017, and U.S. Provisional Patent Application No. 62/638,318, filed Mar. 5, 2018, which applications are incorporated herein by reference. To the extent appropriate, a claim of priority is made to each of the above disclosed applications.

FIELD OF THE DISCLOSED TECHNIQUE

The disclosed technique relates to games in general, and to methods and to ball-in-a-maze puzzle games in particular.

BACKGROUND OF THE DISCLOSED TECHNIQUE

Ball-in-a-maze puzzle games are known in the art. Generally, such games include manipulating a ball through a maze or a labyrinth from a start position to a finish position. Some of such games may include perforations in the platform on which the ball moves. The player needs to avoid these perforations while manipulating the ball toward the finish position.

U.S. Pat. No. 8,011,662 to Black et al, entitled "Three Dimensional Maze Puzzle and Game" directs to a hand-held playing board which includes different maze structures on each of two faces of the board. Holes extend through the board between the two maze structures. Furthermore, each maze structure is divided approximately in half by an impassable barrier. A playing piece is moved by tilting the board. When the ball passes through the board from one maze structure to the other, the board must be turned over to view the other maze structure. A player movies a from the start position at one end on one face through the maze structures back and forth through the board until the ball arrives at a finish position at the other end on the other face.

U.S. Patent Application Publication 2012/0286472 to Harvey, entitled "Pathway Puzzle" directs to a puzzle game which includes a set of coaxial polygons (e.g., such as circles), which are individually rotatable. Each polygon has maze-like pathway on it. Some pathways continue forward from an adjacent outer polygon to an adjacent inner polygon. Some pathways will loop back from an adjacent outer polygon back to that same outer polygon and vice versa while other pathways will simply terminate in dead-ends. The object of the game is to rotate the polygons axially, until they reach a special solution configuration. This solution configuration is achieved when an unbroken pathway exists starting at the outside edge of the outermost polygon, through adjacent polygons, in such a way that it reaches the center polygon and then continues back through adjacent polygons and terminates at the outside edge of the outermost polygon.

BRIEF DESCRIPTION OF THE DRAWINGS

The disclosed technique will be understood and appreciated more fully from the following detailed description taken in conjunction with the drawings in which.

DETAILED DESCRIPTION OF THE EMBODIMENTS

The disclosed technique overcomes the disadvantages of the prior art by providing a novel moving ball-in-A-maze puzzle game. The game includes a plurality of concentric rotating maze rings. Each maze ring includes a respective maze. Each maze ring rotates at a respective direction. Furthermore, each maze ring may rotate at a respective angular velocity. In other words, the angular velocity of each maze rings may be different or identical to the angular velocities of other ones of the maze rings. In general, the maze rings move relative to one another and define dynamic paths therebetween enabling to maneuver a ball on said platform from a start position to an end position through said mazes, while passing between the respective moving maze rings. The term 'dynamic path' refers to a path that changes with time as the rings move the maze rings move relative to one another. According to another alternative, the game includes a plurality of maze belts. Each maze belt includes a respective maze. Each maze belt moves in a respective direction and at a respective velocity. The platform on which the balls move may include perforations. A player aims to manipulate the ball from and start position to an end position through the mazes on the rotating maze rings while avoiding the perforations (i.e., when such exist).

Figure 1A:
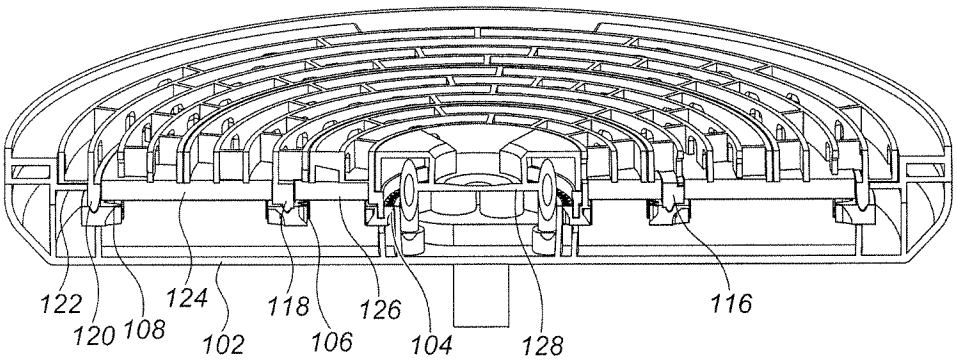
FIGS. 1A-1C are schematic illustrations of a moving ball-in-a-maze puzzle game, constructed and operative in accordance with an embodiment of the disclosed technique.
Figure 1B:
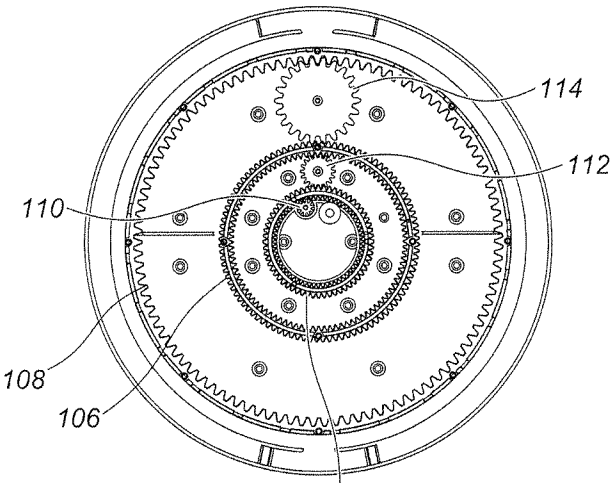
Figure 1C:
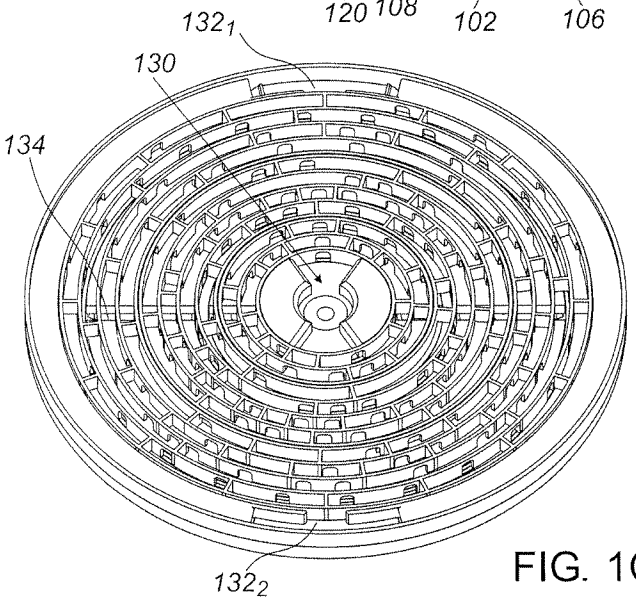

Reference is now made to FIGS. 1A-1C, which is a schematic illustration of a moving ball-in-a-maze puzzle game, generally referenced 100, constructed and operative in accordance with an embodiment of the disclosed technique. Moving ball-in-a-maze puzzle game 100 includes a frame 102, gear rings 104, 106 and 108, gear wheels 110, 112 and 114, maze rings 116, 118 and 120 and platforms 122, 124, 126 and 128. Gear rings 104, 106 include inner and outer gear teeth and gear ring 108 includes inner teeth.

Gear rings 104, 106 and 108 are concentric rings, rotatably coupled with frame 102. Gear wheel 110 is coupled with a power source (e.g., an electric motor, a manually operated handle) and to gear ring 104, such that when gear wheel 110 rotates, gear ring 104 also rotates. Gear wheel 112 is coupled with the outer gear teeth of gear ring 104 and the inner gear teeth of gear ring 106. Thus, when gear ring 104 rotates gear ring 106 also rotates (i.e., though in the opposite directions one with respect to the other). Gear wheel 114 is coupled with the outer gear teeth of gear ring 106 and the inner gear teeth of gear ring 108. Thus, when gear ring 106 rotates gear ring 108 also rotates (i.e., though in the opposite directions one with respect to the other).

Each one of maze rings 116, 118 and 120 is coupled with a respective one of Gear rings 104, 106 and 108 and rotates therewith. Maze ring 116 is coupled with gear ring 104, maze ring 118 is coupled with gear ring 106 and maze ring 120 is coupled with gear ring 108. In the example brought forth in FIGS. 1A-1C, each gear ring 104, 106 and 108 and thus each one of maze rings 116, 118 and 120 rotates and different direction relative to the adjacent ones of maze rings 116, 118 and 120. However, in general, gears may be design to rotate the each maze ring at a respective selected direction and at a respective selected angular velocity.

Platforms 122, 124, 126 and 128 are coupled with frame 102 and are located at the bottom of maze rings 116, 118 and 120. Platforms 122, 124, 126 and 128 may be perforated at selected locations. The size of the perforation allows the game ball to fall there through. Since the platforms are stationary, and the maze rings rotate, the perforations move relative to the maze. As such the relative position of the perforations within the maze, changes.

As described above, maze rings 116, 118 and 120 move relative one relative to the other over a platform. This motion defines dynamic paths between maze ring 116, 118 and 120, enabling to maneuver a ball on platform 122, 124, 126 and 128 from a start position to an end position through the respective mazes of maze rings 116, 118 and 120, while passing between the maze rings 116, 118 and 120. When a player plays with moving ball-in-a-maze puzzle game 100, the player places a ball at a start position and aims to find a way through the moving maze toward an end position. In FIGS. 1A-1C, the start position may be the center 130 of game 100 or at one of the peripheral entry points $\mathbf{132}_1$ or $\mathbf{132}_2$. When starting at center 130, the player aims to find a way for the ball, through the moving maze, toward one of peripheral entry points $\mathbf{132}_1$ or $\mathbf{132}_2$. When starting at one of peripheral entry points $\mathbf{132}_1$ or $\mathbf{132}_2$, the player aims to find a way for the ball, through the moving maze, toward center 130. During the game, each of maze rings 116, 118 and 120 rotate in the respective direction thereof. The player moves ball moves over the platforms 122, 124, 126, through the maze by tilting game 100. While moving the ball through the maze, the player attempts to avoid the perforations, such as perforation 134, in platforms 122, 124, 126 as well as between moving maze rings 122, 124, 126.

Figure 2A:
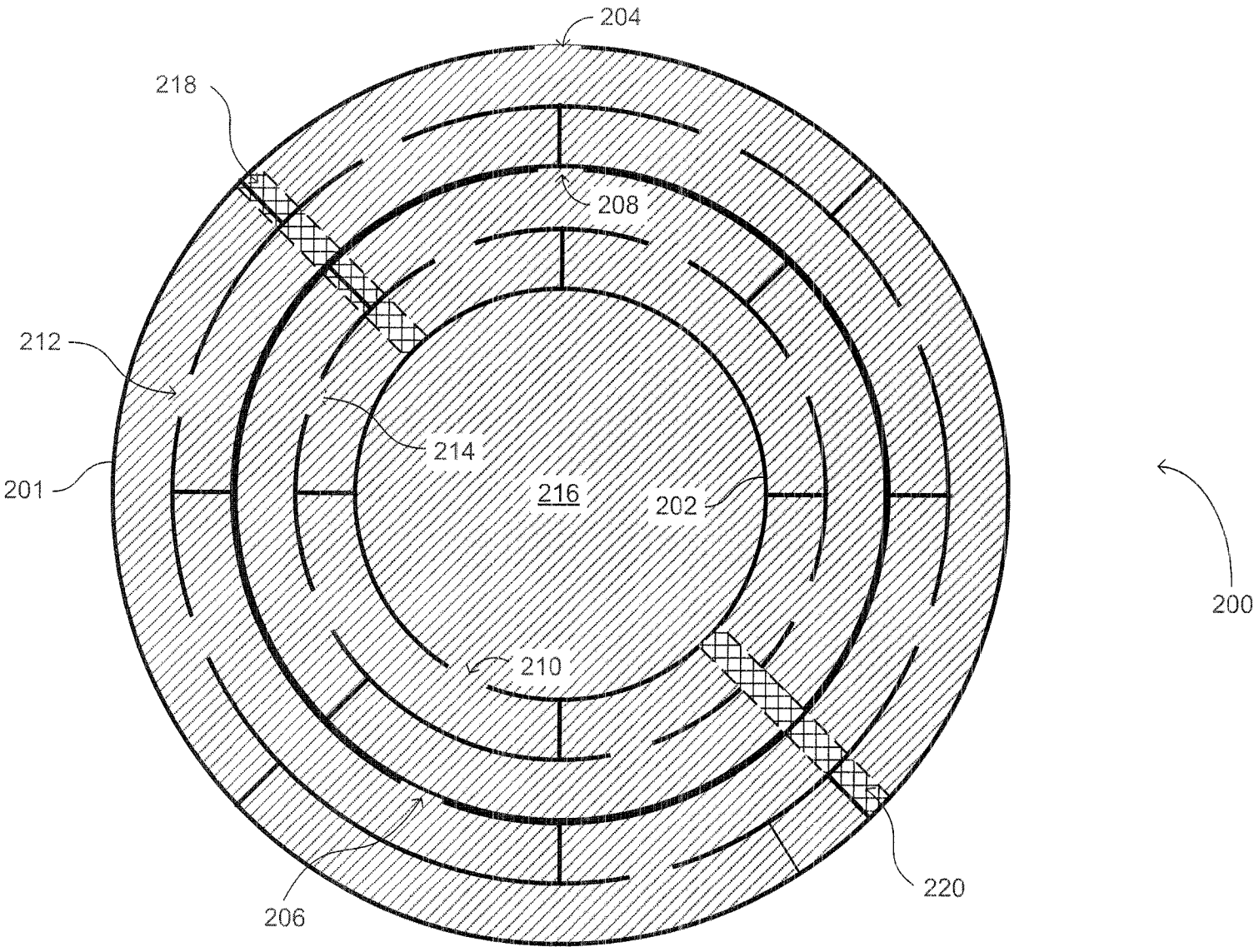
FIGS. 2A-2C are schematic illustrations of exemplary moving ball-in-a-maze puzzle game, constructed and operative in accordance with another embodiment of the disclosed technique.
Figure 2B:
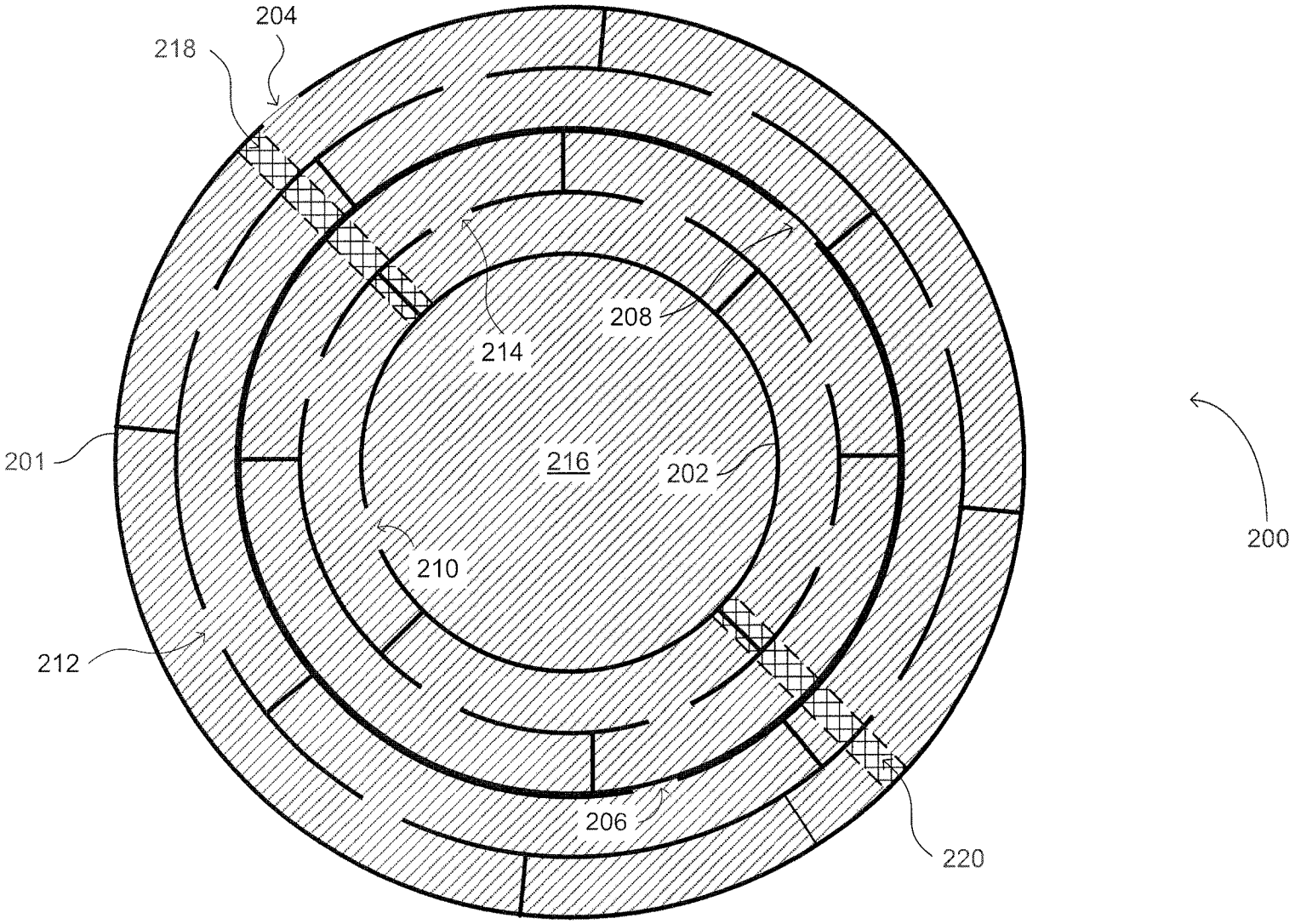
Figure 2C:
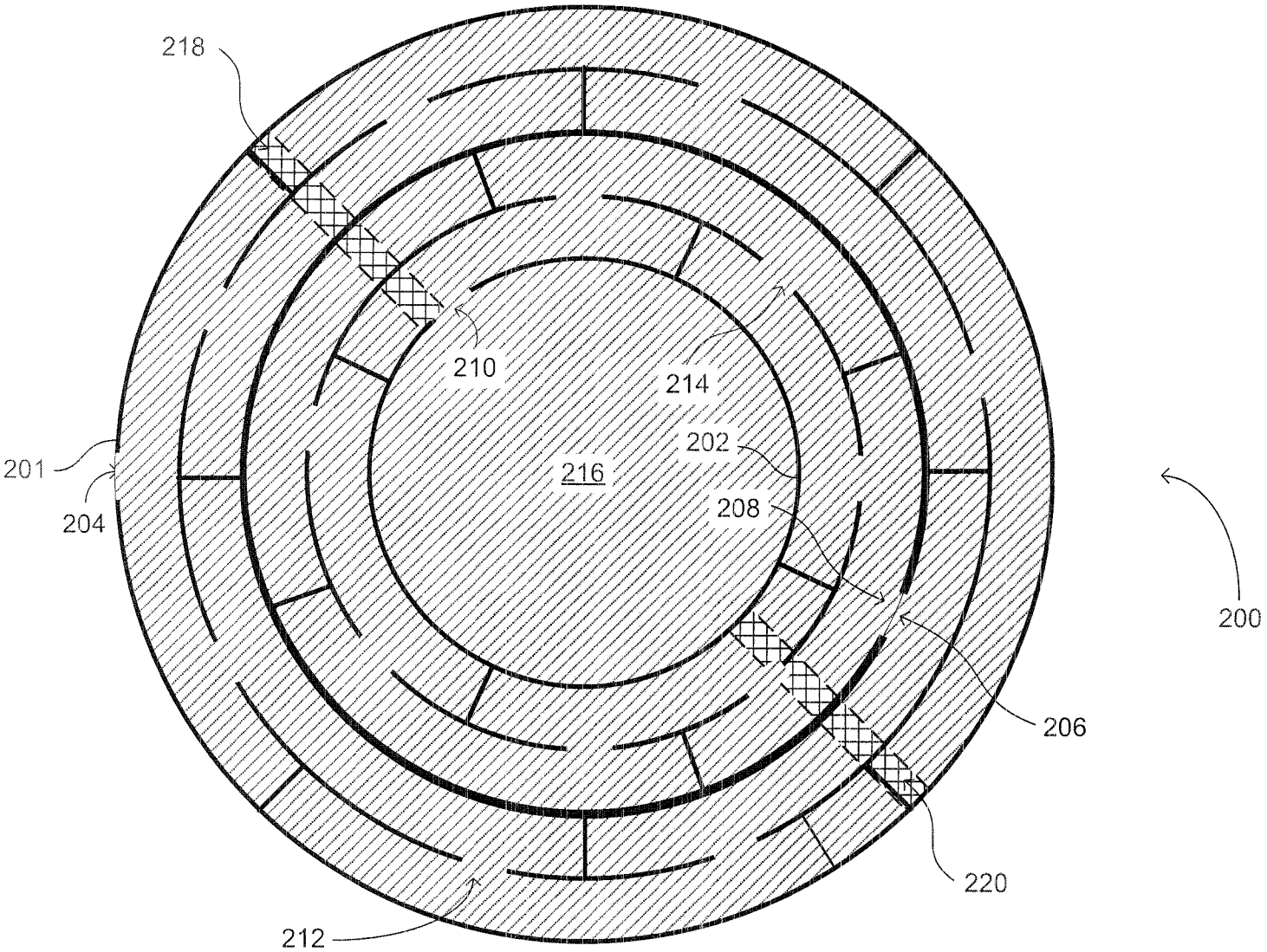

Reference is now made to FIGS. 2A-2C which are schematic illustrations of exemplary moving ball-in-a-maze puzzle game, generally referenced 200, constructed and operative in accordance with another embodiment of the disclosed technique. Game 200 includes two mazes rings 201 and 202. Each of maze rings 201 and 202 includes a respective maze. Maze ring 201 includes opening 204 at the outer edge thereof and opening 206 at the inner edge thereof. Maze ring 202 includes opening 208 at the outer edge thereof and opening 210 at the inner edge thereof. Maze rings 201 and 202 further includes a plurality of maze openings such as maze opening 212 and 214. Maze rings 201 and 201 rotate over a platform 216. Platform 216 includes at least one perforation such as perforations 218 and 220 through which a ball can fall.

In FIGS. 2A-2C, maze ring 201 rotates counter clockwise at a respective angular velocity and maze ring 202 rotates clockwise at a respective angular velocity (i.e., the maze rings move relative to one another). The angular velocity respective of maze ring 201 may be different from the angular velocity of maze ring 202. With reference to FIG. 2A, maze rings 201 and 202 are depicted at a first relative position therebetween. With reference to FIG. 2B, each one of maze rings 201 and 202 rotated at the respective directions and respective angular velocities thereof and are depicted in a second relative position therebetween. With reference to FIG. 2C, each one of maze rings 201 and 202 continued the respective rotation thereof at the respective direction and respective angular velocity and are depicted in a third relative position therebetween. In this third relative position, the opening 206 at the inner edge of maze ring 201 is aligned with opening 208 at the outer edge of maze ring 202. At this position a player may move the ball from maze ring 201 into maze ring 202. Thus, when moving, maze rings 201 and 202 define dynamic paths therebetween enabling to maneuver a ball on said platform from a start position to an end position through the respective mazes, while passing between the respective moving maze rings 201 and 202.

Figure 3A:
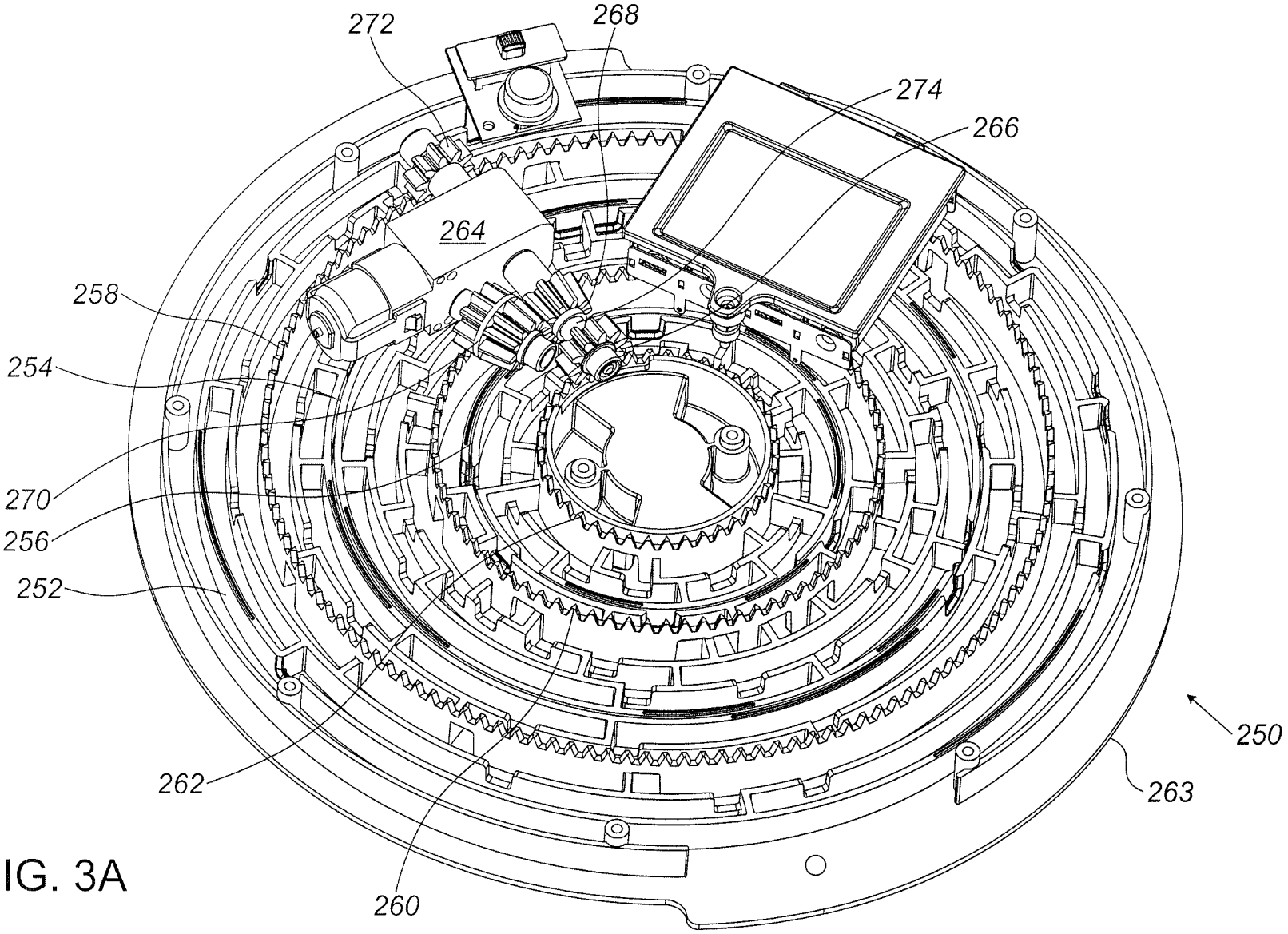
FIGS. 3A-3C are schematic illustrations of exemplary moving ball-in-a-maze puzzle game, constructed and operative in accordance with a further embodiment of the disclosed technique.
Figure 3B:
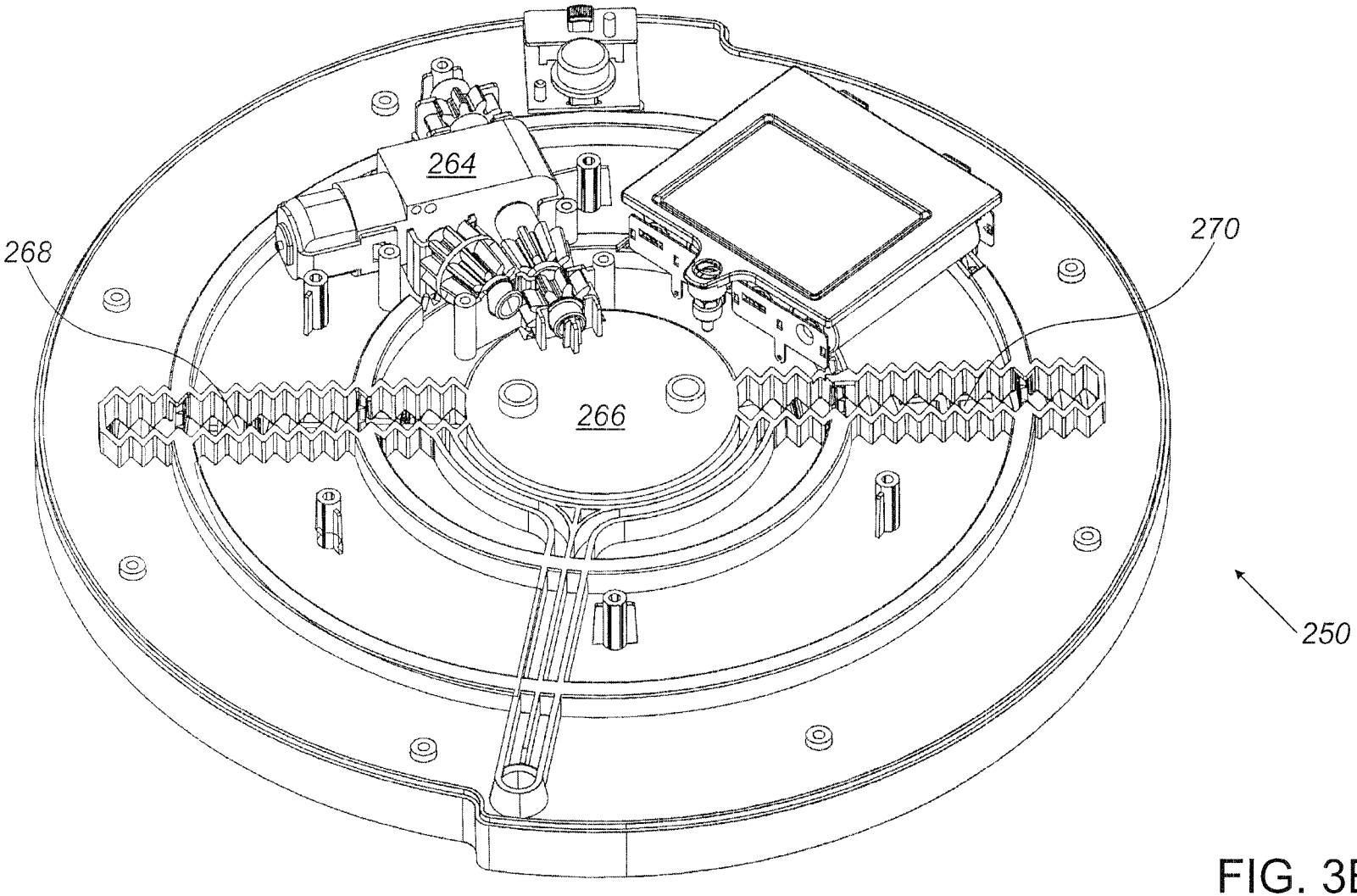
Figure 3C:
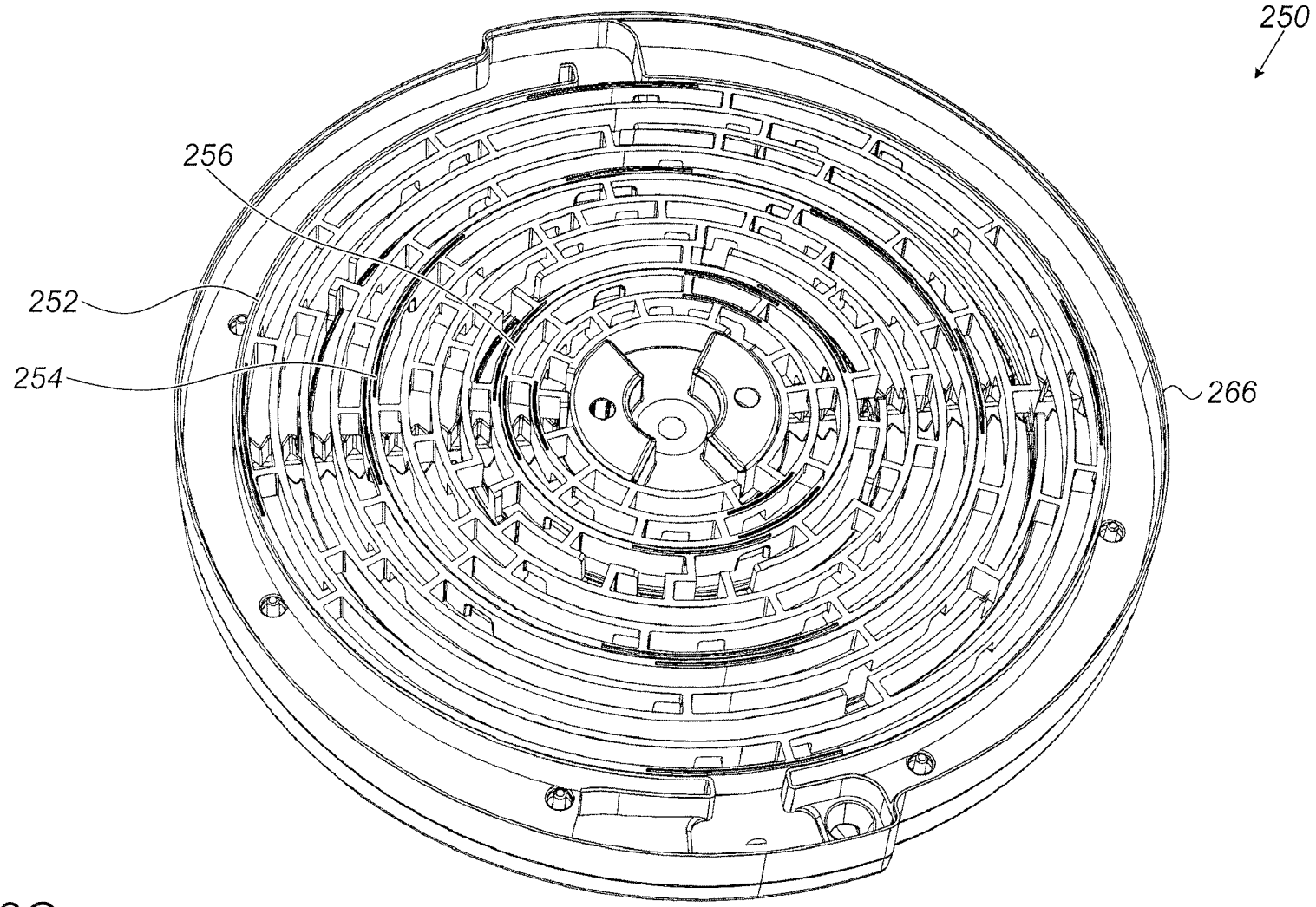

Reference is now made to FIGS. 3A-3C which are schematic illustrations of exemplary moving ball-in-a-maze puzzle game, generally referenced 250, constructed and operative in accordance with a further embodiment of the disclosed technique. Moving ball-in-a-maze puzzle game 250 is similar to Moving ball-in-a-maze puzzle game 100 (FIGS. 1A-1C) and differs only in the arrangement of the gear rings, gear wheels and the motor. Moving ball-in-a-maze puzzle game 250 includes maze rings 252, 254 and 256, gear rings 258, 260 and 262, gear wheels 266, 268, 272 and 272 and a motor 264. Each one of gear rings 258, 260 and 262 is coupled with a respective maze ring 252, 254 and 256.

Gear wheels 266, 268 and 272 are all located on a shaft coupled with motor 264. Gear wheel 268 is coupled gear wheel 270. Gear wheel 266 is coupled with gear ring 262, gear wheel 270 is coupled with gear ring 260 and gear wheel 272 is coupled with gear ring 258. When motor 264 rotates, each one of gear rings 258, 260 and 262 and consequently maze rings 252, 254 and 256 rotates at a respective direction and angular velocity as determined by the arrangement of gear wheels 266, 268, 272 and 272. In the example brought forth in FIGS. 3A-3C, maze rings 258 and 262 rotate in the same direction relative to each other while maze ring 260 rotate in an opposite direction thereto.

The bottom of game 250 (FIG. 3B) is covered with a platform 266 which may include perforations such as perforations 270 and 272. The size of the perforation allows the game ball to fall there through. Since the platforms are stationary, and the maze rings rotate, the perforations move relative to the maze. As such the relative position of the perforations within the maze, changes. Platform 266 includes additional peroration through which gear wheels 266, 268 and 270 come into contact with gear rings 258, 260 and 262. Similar to as described above, maze rings 252, 254 and 256 move relative one relative to the other over a platform. This motion defines dynamic paths between maze rings 252, 254 and 256, enabling to maneuver a ball on platform 266 from a start position to an end position through the respective mazes of maze rings 252, 254 and 256, while passing between the maze rings 252, 254 and 256. Also as describe above, when a player plays with moving ball-in-a-maze puzzle game 250, the player places a ball at a start position and aims to find a way through the moving maze toward an end position.

Figure 4:
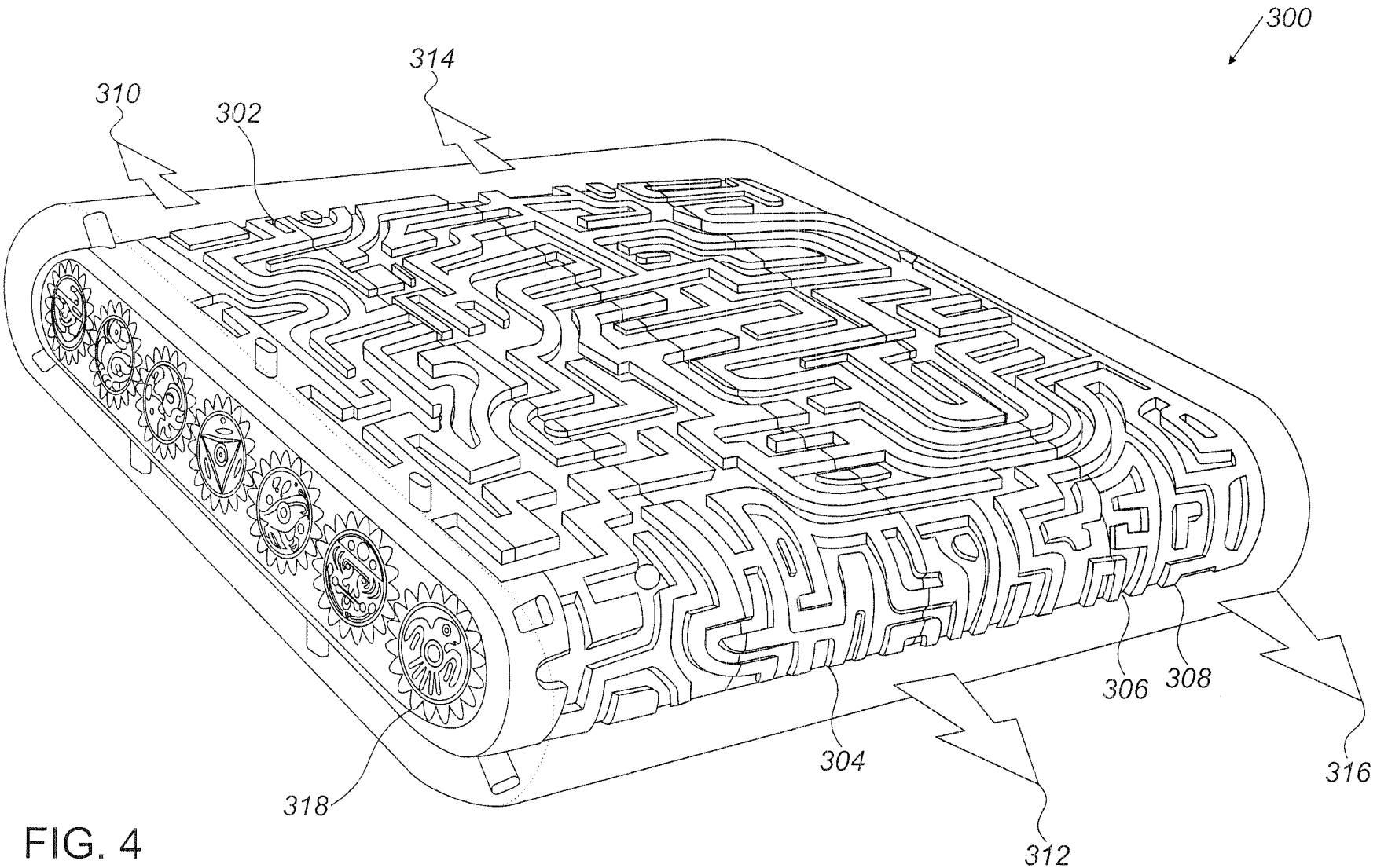
FIG. 4 is a schematic illustration of an exemplary moving ball-in-a-maze puzzle game, constructed and operative in accordance with another embodiment of the disclosed technique.

As mentioned above, moving ball-in-a-maze puzzle game according to the disclosed technique may include a plurality of maze belts instead of maze rings wherein each maze belt includes a respective maze and moves in a respective direction and at a respective velocity. Reference is now made to FIG. 4, which is a schematic illustration of an exemplary moving ball-in-a-maze puzzle game, generally referenced 300, constructed and operative in accordance with another embodiment of the disclosed technique. Moving ball-in-a-maze puzzle game 300 includes four maze belts 302, 304, 306 and 308, each moving in a respective direction. Maze belt 302 moves in a direction indicated by arrow 310, maze belt 304 moves in a direction indicated by arrow 312, maze belt 306 moves in a direction indicated by arrow

314 and maze belt 308 moves in a direction indicated by arrow 316. In other words, maze belts 302, 304, 306 and 308 move relative to one another. The belts are driven by gear wheels, such as gear wheel 318 coupled with a motor. When moving, maze belts 302, 304, 306 and 308 define dynamic paths therebetween enabling to maneuver a ball on said platform from a start position to an end position through the mazes, while passing between the respective moving maze belts.

It will be appreciated by persons skilled in the art that the disclosed technique is not limited to what has been particularly shown and described hereinabove. Rather the scope of the disclosed technique is defined only by the claims, which follow.

The invention claimed is:

1. A moving ball-in-a-maze puzzle game including at least two maze belts and a power source coupled with the maze belts, each maze belt including a respective maze, said power source being configured to continuously move said maze belts relative to one another over a platform during the game, thereby defining dynamic paths between the continuously rotating maze belts, and enabling to maneuver a ball on said platform from a start position to an end position through said mazes, while passing between the continuously rotating maze belts.

2. The moving ball-in-a-maze puzzle game according to claim 1, wherein each maze belt includes an opening at the outer edge thereof, an opening at the inner edge thereof, and a plurality of maze openings.

3. The ball-in-a-maze puzzle game according to claim 1, said platform includes least one perforation.

4. The ball-in-a-maze puzzle game according to claim 1, wherein each adjacent pair of maze belts continuously moves in opposite directions at respective velocities.

5. The ball-in-a-maze puzzle game according to claim 1, wherein each maze belt is coupled with a respective gear wheel, wherein each gear wheel is coupled with the power source.

6. The ball-in-a-maze puzzle game according to claim 1, wherein said power source is one of:

an electric motor; and a manually operated handle.

* * * * *